United States Patent [19]

Falk

[11] Patent Number: 4,711,404

[45] Date of Patent: Dec. 8, 1987

[54] APPARATUS FOR CUTTING A PAPER WEB

[75] Inventor: Carl H. Falk, Karlstad, Sweden

[73] Assignee: Valmet-KMW Aktiebolag, Karlstad, Sweden

[21] Appl. No.: 6,672

[22] PCT Filed: Apr. 29, 1986

[86] PCT No.: PCT/SE86/00194

§ 371 Date: Dec. 23, 1986

§ 102(e) Date: Dec. 23, 1986

[87] PCT Pub. No.: WO86/06357

PCT Pub. Date: Nov. 6, 1986

[30] Foreign Application Priority Data

May 2, 1985 [SE] Sweden ..... 85021186

[51] Int. Cl.[4] ..... B65H 19/26

[52] U.S. Cl. ..... 242/56 R; 242/65; 242/74; 242/76; 83/636; 226/97

[58] Field of Search ..... 242/56 R, 65, 56 A, 242/56.6, 74, 75.2, 76; 83/542, 636, 660, 695; 225/100, 106; 226/97

[56] References Cited

U.S. PATENT DOCUMENTS 2,461,246 2/1949 Weyenberg ..... 242/56 R
3,765,615 10/1973 Brink et al. ..... 242/56 R
3,847,390 11/1974 Dixon ..... 226/97 X
4,414,258 11/1983 Corbin, Sr. ..... 242/74
4,659,029 4/1987 Rodriguez ..... 242/56 R

FOREIGN PATENT DOCUMENTS 2186939 1/1974 France .
86/00282 1/1986 PCT Int'l Appl. .
1135945 12/1968 United Kingdom .

*Primary Examiner*—John M. Jillions
*Attorney, Agent, or Firm*—Bell, Seltzer, Park & Gibson

[57] ABSTRACT

In order to cut a paper web, which is wound in a drum reel-up, by means of a transverse strip forming a free wedge-shaped end, which is passed around a new reeling drum (*7a*) driven by a surface winding drum, the invention proposes an apparatus comprising a conveying channel (15) having a longitudinal aperture (19) facing the surface winding drum (4), and extending below the web (2) up to the vicinity of a nip (27) defined by the surface winding drum (4) and the new reeling drum (*7a*) at a place beside the web. The conveying channel (15) is provided with means for producing gas jets (44, 45) arranged to actuate from both sides a length of strip (*29a*) inserted into the conveying channel (15) in such a manner as to maintain it in position therein for conveyance to the nip (27).

11 Claims, 4 Drawing Figures

APPARATUS FOR CUTTING A PAPER WEB

The present invention relates to an apparatus for cutting a paper web, which is wound in a drum reel-up, by means of a transverse strip means or the like forming a free wedge-shaped end of the moving paper web which is passed around a new reeling drum driven by a surface winding drum.

A number of different apparatuses and methods have previously been suggested for severing and at the same time point cut a paper web when changing reeling drums in a drum reel-up. In one method one or more cutting tools such as knives are used to effect a slit in the paper web running obliquely from one edge to the other, or two slits extending from the middle of the paper web and running obliquely out to each side edge. Examples of this method are described in U.S. Pat. Nos. 3,857,524, 3,889,892, 4,111,377 and 4,444,362.

In another method the paper web is caused to form a ballooned portion or a fold which is inserted between a nip defined by a new reeling drum and the surface winding drum, so that the paper web is torn off close to the finished paper reel. Examples of this method are described in U.S. Pat. Nos. 3,743,199 and 4,146,187.

It is also generally known manually to insert one end of a long ribbon or strip of paper, for instance, into the nip between a new reeling drum and the surface winding drum at a place located at the side of the paper web. The strip of paper has a specific length and is normally placed on the floor in front of the surface winding drum. The end of the strip to be inserted has on its upper surface a binder such as a layer of glue or adhesive tape ensuring that the strip becomes attached to the reeling drum as desired. Since the strip is placed transversely to the paper web, when its one end is inserted into the nip it will be wound helically onto the new reeling drum, and at the same time it effects a slit from one edge of the paper web to the other. The leading wedge of paper web thus formed, i.e. seen in the direction of feed, is guided around the new reeling drum. The manual phase, i.e. insertion of the strip end into the nip, is extremely hazardous since the strip is jerked into the nip at extremely high speed. The operator must therefore make sure he does not come too close to the nip with his hand, and he must also quickly let the strip go and snatch away his hand and body in order to be free from the strip so as not to become entangled in it when the strip is quickly jerked up from the floor into the nip. This risk increases with increased speed of the paper web and the method cannot therefore be used for higher web speeds, e.g. 700 meters per minute and above. The risk also increases if there is a small space under the paper web permitting only creeping.

U.S. Pat. No. 3,847,390 describes a conveying device consisting of an elongated straight conduit provided with a narrow slot running longitudinally so that one edge of a paper web can run in the conduit under the influence of air jets directed towards both sides of this edge inside the conduit.

The object of the present invention is thus to provide a simple and reliable apparatus for automatically feeding and inserting a length of strip into the nip between the new reeling drum and the surface winding drum in order to eliminate the manual work and thus the serious risks to the operator in conjunction with inserting the strip into said nip.

Another object of the invention is to reduce the length of the portion of paper web affected by cutting and to reduce the length of strip required for this operation. This results in fewer turns of strip on the reeling drum and a corresponding reduction in pleating of the paper web which causes considerable rejection of paper web.

The apparatus of the present invention is characterized in that it comprises a conveying channel having a longitudinal, relatively wide aperture facing the surface winding drum, a first portion of the conveying channel being positioned below the paper web and a second curved portion of the conveying channel extending to the vicinity of a nip defined by the surface winding drum and the new reeling drum at a place beside the paper web, and that said conveying channel is provided with means for producing gas jets arranged to actuate from both sides a length of strip means inserted into the conveying channel in such a manner as to maintain it in position therein for conveyance to the nip.

The gas jets suitably consist of air jets. According to a preferred embodiment said means for producing gas jets comprise longitudinal air channels connected to a source of compressed air and extending on both sides of the aperture, said air channels being provided with holes directed inwardly into the conveying channel.

According to another preferred embodiment of the invention, the apparatus comprises a feeding means mounted in conjunction with the inlet end of the conveying channel facing away from the nip, said feeding means containing a supply of strip, a drive source for feeding a length of strip until the free end of the strip has reached the nip, and a retaining device for retaining the strip when said length of strip has been fed forward.

The invention will be described further in the following detailed description with reference to the accompanying drawings in which.

Figure 1:
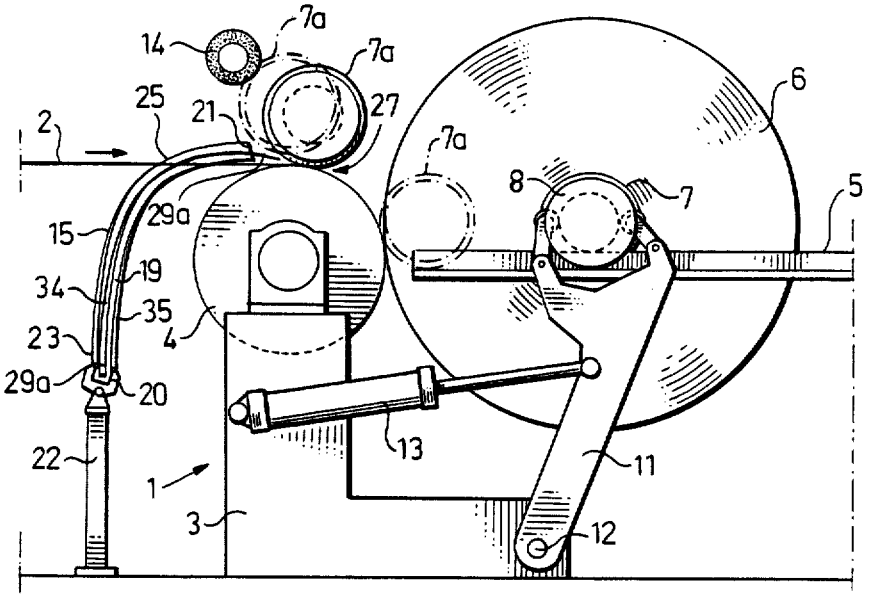
FIG. 1 shows a drum reel-up schematically from the side and a conveying channel of an apparatus according to a preferred embodiment of the invention mounted in connection therewith, the figure illustrating insertion of a new reeling drum in the drum reel-up.
Figure 2:
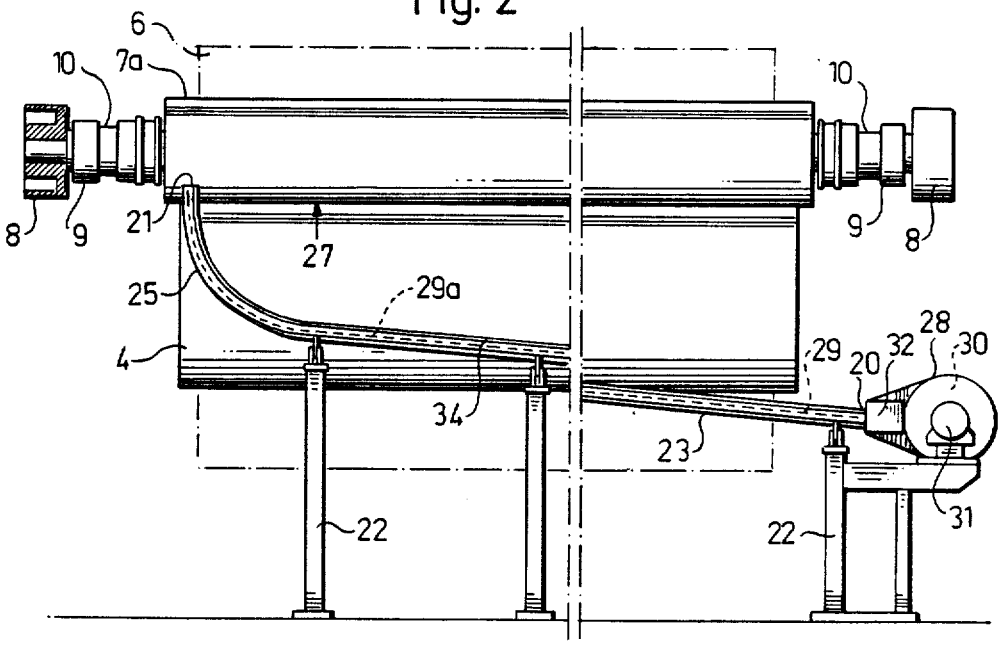
FIG. 2 is a view of parts of the drum reel-up and the apparatus according to FIG. 1 seen in the direction of movement of the paper web.
Figure 3:
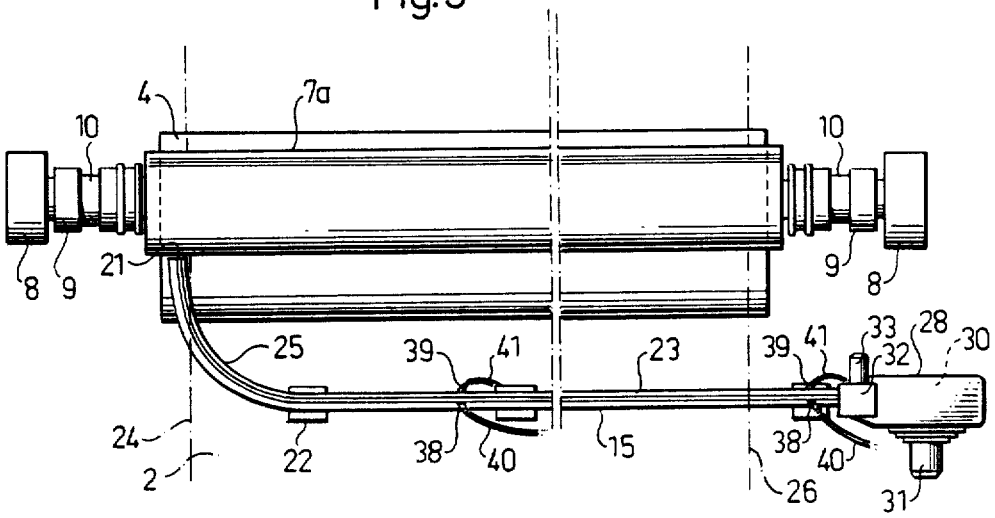
FIG. 3 is a view from above of parts of the drum reel-up and the apparatus according to FIG. 1.

Referring to FIG. 1, a drum reel-up 1 of a paper machine is shown schematically from the side. Paper is manufactured in the form of a continuous web 2. The drum reel-up comprises a stand 3 with a surface winding drum 4 rotatably journalled thereon, the peripheral speed being in agreement with the speed of feeding of the paper web 2. The drum reel-up 1 also comprises two parallel rails 5, one on each side of the paper web, to support a paper reel 6 produced by the paper web 2 being wound around a reeling drum 7, and also one or more finished paper reels (not shown). As can be seen more clearly in FIGS. 2 and 3, the reeling drum is provided at its ends with braking drums 8 and bearing housings 9, the bearing housings 9 having grooves 10 cooperating with said parallel rails 5. Two press arms 11 are also arranged outside the rails 5, said arms being pivotally journalled on the stand 3 about coinciding horizontal shafts 12. Each press arm is turned by means of a cylinder 13 and has a fork-shaped head in engagement with the reeling drum 7 at its bearing housing 9. By means of said press arms 11 the paper reel 6 is pressed against the driving surface winding drum 4 in controlled manner so that the paper reel is driven continuously by the surface winding drum 4 by friction, at the same peripheral speed as the speed of the paper web.

FIG. 1 illustrates a new reeling drum 7a to which the paper web 2 is to be transferred when the preceeding paper reel 6 has reached the desired size. The reeling drum is transferred from a supply of empty reeling drums (not shown) to the surface winding drum 4 by means of a suitable lifting equipment (not shown which may be operated manually or operates automatically. The reeling drum 7a is held in a first position slightly above the surface winding drum 4 by means of a suitable support means (not shown), the bearing housings 9 of the reeling drum 7a resting on said support means. A motor-driven starting device 14 is mounted on one side of the drum reel-up 1 to cause the reeling drum 7a to rotate at the same speed as the surface winding drum 4 in order to avoid friction when the reeling drum 7a is lowered by said support means in order to make contact with the surface winding drum 4 and be driven by this in the position indicated by unbroken lines.

According to the invention an apparatus is provided in conjunction with the drum reel-up for automatic transfer of the paper web 2 from the finished paper reel 6 to a new reeling drum 7a. Said apparatus comprises an elongated conveying channel or conduit 15 which, in the embodiment shown, has a U-shaped cross section and comprises a flat bottom member 16 and two side walls 17, 18, preferably parallel to each other, defining between them an aperture 19. The aperture 19 is relatively wide, preferably in the order of 7 cm, and extends continuously along the entire conveying channel 15 from its inlet end 20 to its outlet end 21. The aperture 19 faces towards the surface winding drum 4. The conveying channel 15 is rigidly mounted on support posts 22. As is clear from FIG. 1, the conveying channel 15 extends below the paper web at a suitable distance from the surface winding drum 4. The conveying channel 15 comprises a first, straight portion 23 which starts with its inlet end 20 at a predetermined distance from and outside the edge 26 of the paper web and extends in under the paper web, and a second, curved portion 25 which starts at a suitable distance from and inside the edge 24 of the paper web and extends at a suitable distance from and outside the last-mentioned edge 24 so that this portion 25 with said outlet end 21 terminates immediately in front of or in the vicinity of a nip 27 defined by the surface winding drum 4 and the reeling drum 7a. The aperture 19 of the conveying channel 15 is sufficiently wide as mentioned above to permit the length of strip 29a to be jerked out of the conveying channel 15 without obstruction when the free end of the length of strip has passed the outlet end 21 of the conveying channel 15 and been inserted into the nip 27.

In connection to the inlet end 20 of the conveying channel 15 there is a feeding means 28 supported by a stand and comprising a supply of a strip, ribbon or the like 29 of suitable material and suitable width. Said supply of strip is in the form of a roll 30 driven by a drive source in the form of a motor 31. The strip may consist of one or more layers of paper or plastic with or without reinforcement, and its width is suitably about 2–8 cm, preferably 4–6 cm. The feeding means 28 has an outlet in alignment with the inlet end 20 of the conveying means and coincides therewith substantially without any gap. The feeding means 28 is also provided with a retaining device 32 mounted at its outlet in order to retain the strip when a desired length of strip 29a has been fed from the roll 30 but permits the strip to run freely when such a desired length is again to be conveyed to the nip 27. If the retaining effect is sufficient and the strip is relatively easily torn or severed, the retaining device 32 will also have a severing function as the length of strip 29a is jerked off close to the retaining device when it is wound onto the reeling drum 7a. Alternatively the feeding means 28 includes a strip actuating means (not shown), such as a cutting tool, which is mounted to sever or facilitate severing the length of strip 29a from the roll 30. The retaining device 32 comprises a cylinder 33, such as a pneumatic cylinder, the piston rod of which supporting a plate (not shown) which is movable to and from a support plate (not shown). In its forward position, therefore, the movable plate clamps the strip 29 between itself and the support plate and in its withdrawn position allows free passage for the strip 29 therebetween. Said strip actuating means may be formed on at least one of said plates for effecting suitable tear indications in the form of perforations or one or more slits, for instance, which are arranged to facilitate severing the length of strip 29a from the roll 30.

Figure 4:
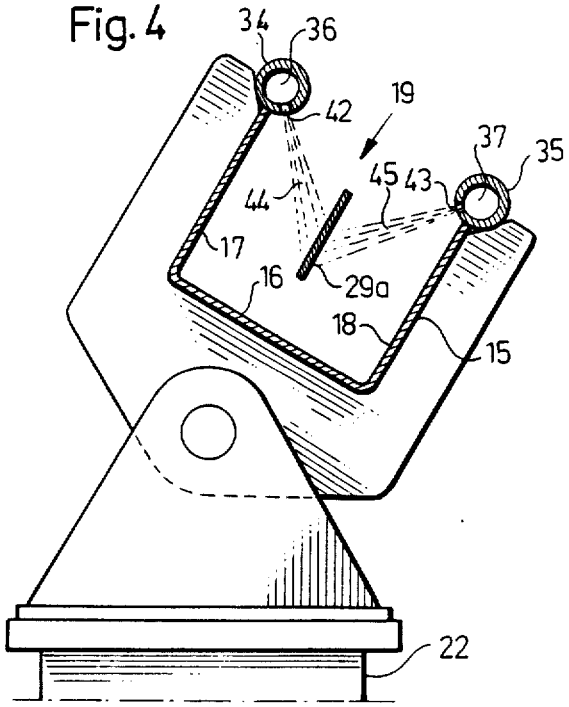
FIG. 4 is a cross section through the conveying channel of the apparatus.

The conveying channel 15 is provided with means for producing gas jets 44, 45 intended to actuate from both sides a length of strip 29a inserted into the conveying channel 15 so that the strip is maintained in position therein for conveyance to the nip 27. As can be seen more clearly in FIGS. 3 and 4, said means for producing gas jets comprise narrow tubes 34, 35 extending longitudinally on each side of the aperture 19, thereby forming longitudinal air channels 36, 37. The tubes are provided with nipples 38, 39 for connection to air hoses 40, 41 connected to a source of compressed air (not shown). For each tube 34, 35 there is a nipple 38, 39 and hose connection at the inlet end 20 of the conveying channel and another nipple 38, 39 and hose connection at approximately the middle of the conveying channel 15 ensuring that the air pressure is maintained also in the downstream sections of the air channels 36, 37. Additional nipples and hose connections may be mounted along the tubes if desired. Each tube 34, 35 is provided with a plurality of holes 42, 43 on the side facing the inside of the conveying channel 15. The holes 42, 43 are distributed with even spaces along the tubes and directed obliquely forwardly in the direction of movement of the strip 29. A suitable angle for the holes is about 45° to said direction of movement. The alignment of these holes is also such that the air jets 44, 45 are operative within the central region of the conveying channel 15 and towards each other in order to carry the strip 29 in such a manner that it will run freely as far as possible, without coming in contact with the bottom member 16 and side walls 17, 18. The holes 42 in tube 34 have the same cross section as the holes 43 in the second tube 35.

To enable the strip 29 to accompany the reeling drum 7a as desired, a special device (not shown) may be placed at the outlet end 21 of the conveying channel, said device applying, for instance by spraying, an adhesive layer on the upper side of the strip 29a being fed out of the conveying channel 15 so that the strip becomes attached to the reeling drum 7a upon entering the nip 27. Alternatively a device may be positioned on the side of the nip 27 facing away from the conveying channel 15, said device directing air jets straight against the reeling drum and in line with the strip in such a manner that the strip will be pressed against the reeling drum 7a and thereby accompanies the reeling drum around its circumference, ensuring that the strip is wound onto the reeling drum 7a.

The outlet end 21 of the conveying channel is so directed in relation to the nip 27 that the strip is fed out of the conveying channel substantially perpendicular to the nip. The length of the conveying channel 15 is such that a sufficient length of strip is obtained to ensure the entire width of the paper web being severed when the length of strip is wound onto the reeling drum 7.

Instead of said tubes and air channels, according to an alternative embodiment separate tubes may be conducted from a compressed air source to suitable nozzles mounted in the conveying channel to provide air jets in a manner corresponding to that in the embodiment shown.

The apparatus shown operates in the following manner.

As will be seen in FIG. 1, a new reeling drum 7a (unbroken lines) is placed in its starting position to be driven by the surface winding drum 4 in the direction indicated by the arrow. At least as soon as an indication is received that the paper reel 6 is approaching the desired size, the motor 31 is started for feeding the strip 29 from the roll 30, and the air supply to the air channels 36, 37 of the conveying channel 15. The strip 29 is maintained and guided in the correct position and direction in the conveying channel 15 by means of the air jets 44, 45 at the same time as it is fed forwards therein. When the free end of the strip reaches the nip 27 the motor 31 is automatically disconnected in suitable manner, e.g. by the correct length of strip being recorded or the arrival of the free end of the strip at the outlet end 21 or nip 27 being recorded. If the strip has not quite reached the nip the obliquely directed air jets will carry it the last distance. When the correct length of strip 29a has been fed forward, the retaining device 32 is connected to retain the strip and a layer of adhesive is sprayed on the upper side of the strip 29a at its free end. The strip is jerked quickly into the nip 27 and adheres to the reel 7a. As soon as the strip has entered the nip 27, or immediately thereafter, the strip will be subjected to tensile force and thus jerked out of the conveying channel 15 through its longitudinal aperture 19. Since the length of strip 29a extends along the reeling drum 7a it will be wound onto the reeling drum in a spiral. Since the strip extends along the lower surface of the paper web and is spirally wound onto the reeling drum, it will cut through the paper web and form a cut which extends from one edge 24 to the other edge 26 of the web. The distance between the starting of the cut at the edge 24 and its end at the other edge 26 seen in the longitudinal direction of the paper web will be relatively short - substantially shorter than when the strip is introduced manually into the nip in an operation with a high degree of risk. Due to the tensile force accumulated in the strip while it is wound spirally on the reeling drum, it will be severed in an intermediate or final phase at the feeding means 28, after which a new length of strip can be fed forward the next time a new reeling drum is to be inserted in the drum reel-up.

When the paper web is cut a free, wedge-shaped end is formed, its tip pointing in the direction of feed of the web. This wedge end is brought into contact with the reeling drum as soon as the tip has passed the nip 27. When the paper web has been transferred to the new reeling drum 7a as described, the reeling drum is lowered to the righthand position shown in broken lines in FIG. 1, to rest on the rails 5 while still being driven from the surface winding drum 4.

I claim:

1. An apparatus for cutting a paper web, which is wound in a drum reel-up, by means of a transverse strip means or the like forming a free, wedge-shaped end of the moving paper web which is passed around a new reeling drum (7a) driven by a surface winding drum (4), characterized in that it comprises a conveying channel (15) having a longitudinal, relatively wide aperture (19) facing the surface winding drum (4), a first portion (23) of the conveying channel (15) being positioned below the paper web (2) and a second curved portion (25) of the conveying channel extending to the vicinity of a nip (27) defined by the surface winding drum (4) and the new reeling drum (7a) at a place beside the paper web (2), and that said conveying channel (15) is provided with means for producing gas jets (44, 45) arranged to actuate from both sides a length of strip means (29a) inserted into the conveying channel (15) in such a manner as to maintain it in position therein for conveyance to the nip (27).

2. An apparatus according to claim 1, characterized in that said means for producing gas jets comprise longitudinal air channels (36, 37) connected to a source of compressed air and extending on both sides of the aperture (19), said air channels (36, 37) being provided with holes (42, 43) directed inwardly into the conveying channel (15) to produce air jets (44, 45).

3. An apparatus according to claim 1 or 2, characterized in that it comprises a feeding means (28) mounted in conjunction with the inlet end (20) of the conveying channel (15) facing away from the nip (27), said feeding means (28) containing a supply of strip means (29), a drive source (31) for feeding a length of strip means (29a) until the free end of the strip means has reached the nip (27), and a retaining device (32) for retaining the strip means when said length of strip means has been fed forward.

4. An apparatus according to claim 1, characterized in that the aperture (19) of the conveying channel is sufficiently wide to permit the length of strip means (29a) to be jerked without obstruction out from the conveying channel (15) when the free end of the length of strip means has passed the outlet end (21) of the conveying channel (15) and been inserted into the nip (27).

5. An apparatus according to claim 3, characterized in that said feeding means (28) includes a strip actuating means mounted to sever or facilitate severing of the length of strip means (29a) from said supply of strip means.

6. An apparatus according to claim 5, characterized in that the retaining device (32) comprises a support plate and a plate movable in relation thereto, arranged in its forward position to clamp the strip means (29) between itself and the support plate, and in withdrawn position to allow free passage for the strip means therebetween, and that said strip actuating means is located on at least one of said plates to effect tear indications in the form of perforations or one or more slits arranged to facilitate severing of the length of strip means from said supply of strip means.

7. An apparatus according to claim 3, characterized in that the inlet end (20) of the conveying channel is positioned at the side of and at a predetermined distance from the paper web in order to obtain a sufficient length of strip means.

8. An apparatus according to claim 1 characterized in that the inlet end (21) of the conveying channel (15) is so aligned with respect to the nip (27) that the strip means (29) is fed out of the conveying channel (15) substantially perpendicular to the nip.

9. An apparatus according to claim 1, characterized in that the conveying channel (15) has a U-shaped cross section and comprises a flat bottom member (16) and two parallel side walls (17, 18).

10. An apparatus according to claim 2 characterized in that the holes (42, 43) from the air channels (36, 37) are arranged so that the air jets (44, 45) act substantially in the center of the conveying channel (15), the holes (42, 43) being aligned obliquely forward seen in the direction of movement of the strip means in the conveying channel (15).

11. An apparatus according to claim 6, characterized in that said movable plate of the retaining device (32) is supported by a piston rod of a cylinder (33).

* * * * *

UNITED STATES PATENT AND TRADEMARK OFFICE

CERTIFICATE OF CORRECTION

PATENT NO. : 4,711,404

DATED : December 8, 1987

INVENTOR(S) : Carl H. Falk

It is certified that error appears in the above-identified patent and that said Letters Patent is hereby corrected as shown below: On the Title Page, Item [73]

Please change Assignee of Patent from "Valmet-KMW Aktiebolag, Karlstad, Sweden" to -- Valmet Paper Machinery, Inc., Helsinki, Finland --.

Signed and Sealed this

Twenty-eighth Day of June, 1988

*Attest:*

DONALD J. QUIGG

*Attesting Officer*

*Commissioner of Patents and Trademarks*